United States Patent [19]

Lee

[11] Patent Number: 5,063,367

[45] Date of Patent: Nov. 5, 1991

[54] METHOD AND APPARATUS FOR PRODUCING COMPLEX MAGNETIZATION PATTERNS IN HARD MAGNETIC MATERIALS

[75] Inventor: J. Kelly Lee, Rochester, N.Y.

[73] Assignee: Eastman Kodak Company, Rochester, N.Y.

[21] Appl. No.: 576,753

[22] Filed: Sep. 4, 1990

[51] Int. Cl.[5] ..... H01F 7/20; H01F 13/00; G08B 13/24; G08B 13/14

[52] U.S. Cl. ..... 335/284; 340/551; 340/572; 335/303

[58] Field of Search ..... 335/284; 340/551, 572

[56] References Cited

U.S. PATENT DOCUMENTS 4,381,492 4/1983 Steingroever et al. ..... 335/284
4,470,031 9/1984 Steingroever et al. ..... 335/284
4,684,930 8/1987 Minasy et al. ..... 335/284
4,737,753 4/1988 Oudet ..... 335/284

*Primary Examiner*—Leo P. Picard
*Assistant Examiner*—R. Barrera
*Attorney, Agent, or Firm*—Dennis R. Arndt

[57] ABSTRACT

A method and apparatus for producing complex magnetization patterns in a sheet of magnetic material. A fixture having top and bottom plates with a matching conductor pattern embedded in one surface of each plate. The conductor pattern covers substantially the entire surface of each plate. To magnetize the sheet of magnetic material, it is placed between the plates and a magnetizing current is applied to the conductors with a capacitor discharge magnetizer. The resulting sheet of magnetized material is useful as a magnetic deactivator for electromagnetic security articles.

8 Claims, 2 Drawing Sheets

METHOD AND APPARATUS FOR PRODUCING COMPLEX MAGNETIZATION PATTERNS IN HARD MAGNETIC MATERIALS

TECHNICAL FIELD

The invention relates to methods and apparatus for producing complex magnetization patterns in magnetic materials.

BACKGROUND ART

In magnetic type security systems for protecting articles from theft, magnetic targets are employed having detection strips of highly permeable easily saturable magnetic material such as permalloy and deactivation strips of high coercivity, magnetically hard material, such as vicalloy. The deactivation strips are magnetized by a deactivator at a point of sale terminal by subjecting them to a complex magnetic field to neutralize the detection strip. U.S. Pat. No. 4,684,930 shows a deactivator comprising a non-magnetic roller having a magnetic layer comprising a plurality of permanent magnets forming a diamond shaped pattern of magnetization at the surface of the roller.

The diamond shaped pattern is produced by two groups of elongated magnets magnetized transversed to their length and arranged along side each other to form parallel lines of alternate polarity. The magnets of each group form a layer, and the layers formed of the two groups are arranged one on top of the other, with the magnets in one group extending in a different direction than the magnets in the other group. To enable the magnetic field strength from the bottom layer of magnets to be nearly equal to the strength from the top layer at the surface of the roller, the bottom layer of magnets is magnetized more strongly than the top layer.

This method of producing the deactivator suffers from the problems that the manufacturin process is complex and therefore costly, and the resulting field strength in the deactivator is lower than the maximum field strength achievable in the magnetic material.

DISCLOSURE OF THE INVENTION

It is the object of the present invention to provide an improved method for producing complex magnetization patterns in magnetic materials. It is a further object of the invention to provide an improved process for producing a deactivator of the of the type having a complex magnetic pattern.

The object is achieved according to the present invention by magnetizing a sheet of magnetic material in a magnetizing fixture having top and bottom plates, the top and bottom plates each having a conductor embedded in one surface therefore. In operation, a sheet of magnetic material is placed between the plates and an electric current is applied to the conductors by a capacitor discharge magnetizing circuit. According to a preferred embodiment of the invention, the plates are high permeability, low-carbon steel and the conductors are copper wires epoxied into grooves machined in the surfaces of the plates in a folded serpentine pattern.

MODES OF CARRYING OUT THE INVENTION

Figure 1:
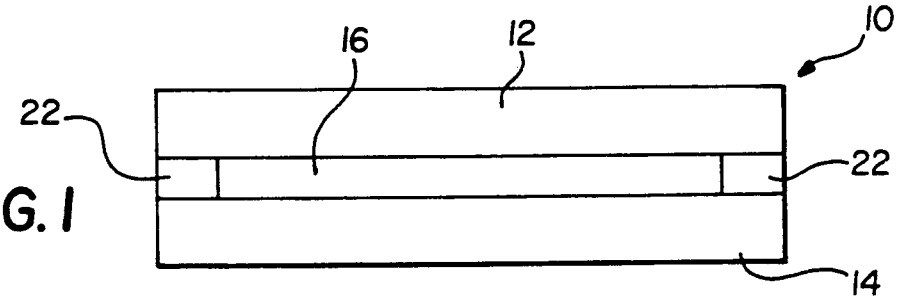
FIG. 1 is an end view of the magnetizing fixture according to the present invention.

Referring to FIG. 1, a magnetizing fixture 10 according to the present invention includes a top plate 12 and a bottom plate 14. A sheet of magnetic material 16 is placed between the plates for magnetizing. The magnetic material 16 is preferably barium-ferrite or strontium-ferrite in a rubber binder such as 3M Electrical Products Division B-1030. The magnetic properties are $B_R=2450$ G., $H_{ci}=3300$G., $H_c=2200$ $O_c$, and B-$H_{max}=1.4$ $MGO_c$. The thickness is approximately 1/16 inch.

Figure 2:
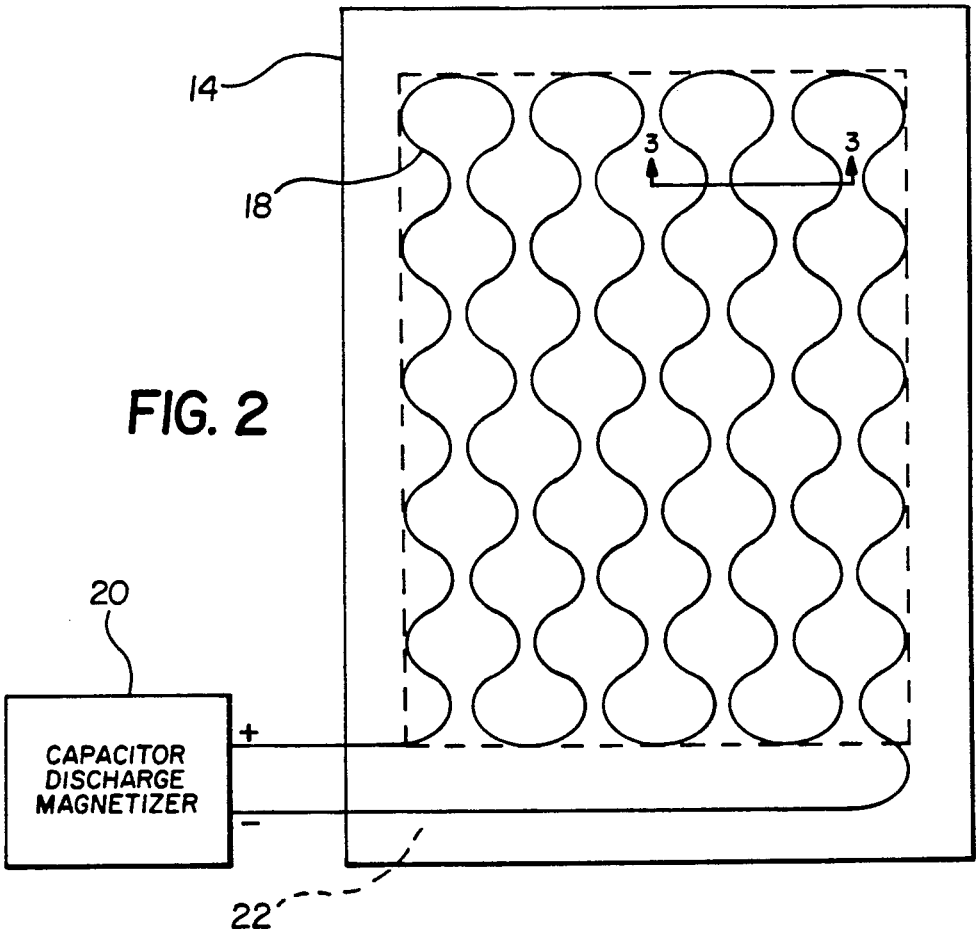
FIG. 2 is a plan view of one of the plates of the magnetizing fixture.

Referring now to FIG. 2, the bottom plate 14 is shown in plan view. Embedded in the surface of the bottom plate 14 is an electrical conductor 18 that forms a pattern substantially covering the surface of plate 14. Although the conductor pattern preferred is a folded serpentine pattern as shown, other surface covering patterns may be employed.

The conductor 18 is connected to a capacitor discharge magnetizer 20. The plate 14 is preferably constructed from a high permeability, low-carbon, mild steel plate. A serpentine groove is formed in the surface of the plate using a numerically controlled milling machine, and the conductor 18, preferably copper wire is embedded in the groove with an epoxy adhesive. The top plate 12 is constructed in a similar manner to bottom plate 14, with a matching conductor pattern. The conductor from the top plate 12 is likewise connected to the capacitor discharge magnetizer 20.

A spacer 22 having the same thickness as the magnetic material may be placed around the periphery of the sheet of magnetic material 16. The spacer is employed to keep the conductors 18 from dislodging from their grooves in the plates 12 and 14 in areas not covered by the magnetic material.

Figure 3:
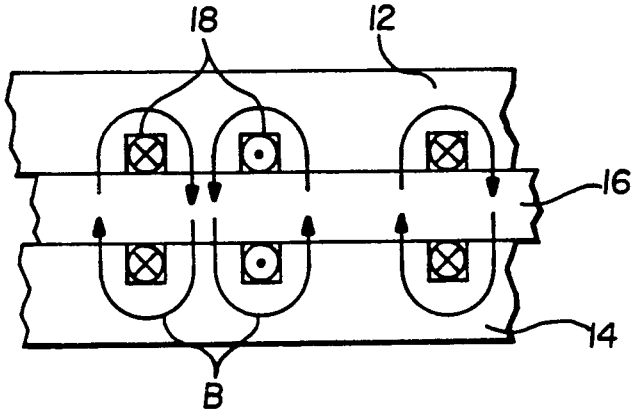
FIG. 3 is a partial cross sectional view of the magnetizing fixture.

In operation, a sheet of magnetic material 16 is placed between the top and bottom plates 12 and 14, and a pulse of current is supplied to the conductors 18 from the capacitor or discharge magnetizing circuit 20. FIG. 3, which shows a partial cross section of the fixture taken along lines 3—3 in FIG. 2 illustrates the resulting magnetic field lines B that are generated by the fixture to magnetize the sheet of magnetic material.

Figure 4:
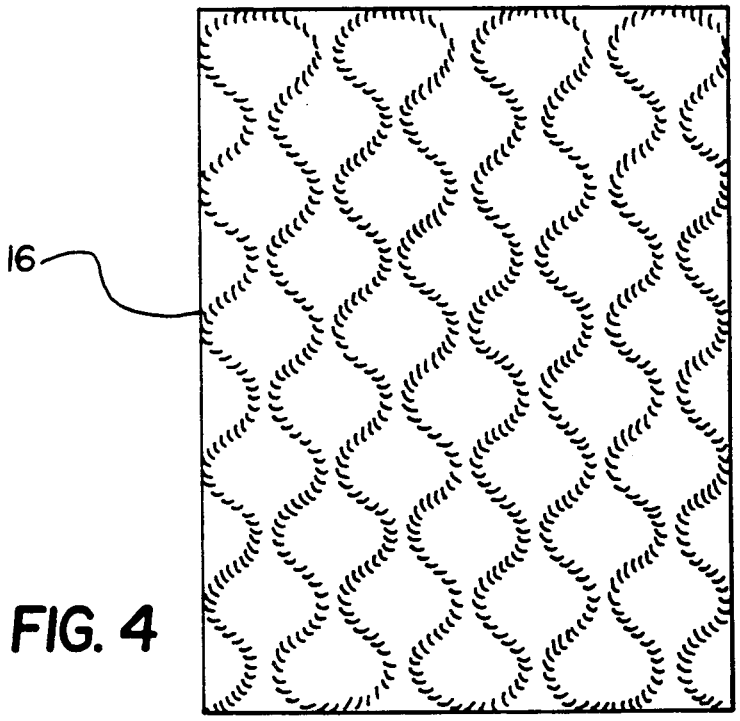
FIG. 4 is a schematic of a magnetic field pattern produced according to the present invention.

A magnetizing $15''\times21''\frac{1}{2}''$ fixture was constructed having top and bottom plates 1.2 cm thick and a folded serpentine pattern of 16 gauge copper wire embedded in the surfaces thereof. The pitch of the serpentine pattern was $\frac{5}{8}''$ mm. A capacitor discharge magnetizer capable of delivery a 50K amp pulse for 100 μsec. was connected to the fixture, and a 1/16" mm thick sheet of magnetic material was magnetized in the fixture. The resulting magnetic pattern had the appearance shown in FIG. 4 when viewed with a magnetic viewer paper from Eurand America Inc., Dayton, Ohio.

Figure 5:
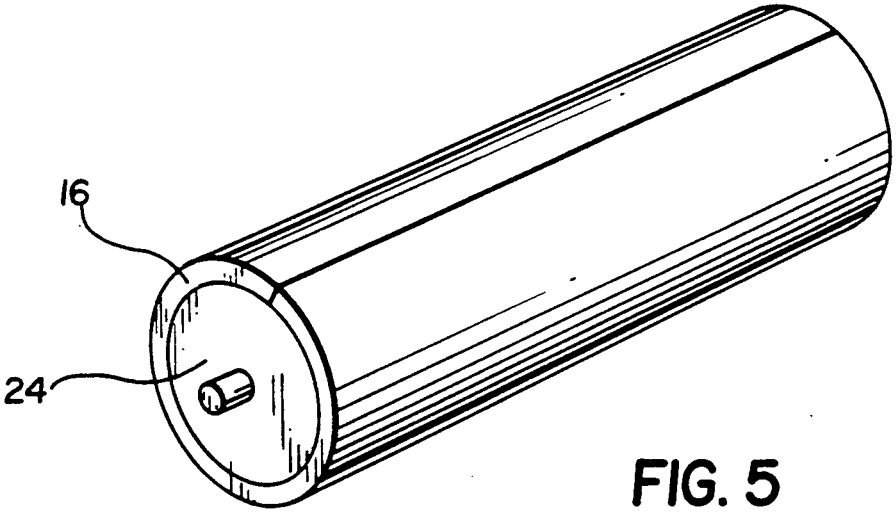
FIG. 5 is a perspective view of a rolling cylinder type magnetic deactivator according to the present invention.

The magnetized sheet 16 was successfully employed to deactivate magnetic security strips regardless of the orientation of the strips with respect to the magnetic sheet. As shown in FIG. 5, the magnetic sheet 16 can be affixed to the surface of a non-magnetic cylinder 24 to make a rolling cylinder type magnetic deactivator.

Although in the preferred embodiment described above, the plate 12 and 14 are constructed from low-carbon steel, a the plates can be constructed with non-magnetic materials such as aluminum or phenolic. In the examples constructed with steel plates the weight of the plates themselves is sufficient to keep the plates together during the magnetization process. However, if lighter materials are employed for the plates such as aluminum or phenolic, it may be necessary to clamp the plates together during magnetization.

In the embodiment described above, a single copper wire conductor 18 is embedded in the surface of the plates. Alternatively, the grooves in the plate can be made deeper, and two or more strands of wire may be embedded in the plate.

INDUSTRIAL APPLICABILITY AND ADVANTAGES

The magnetizing method and apparatus according to the present invention and articles produced therewith are useful in demagnetizing magnetic security targets. The method and apparatus have the advantage of being simpler and less expensive than the prior art methods, and the magnetic deactivators produced thereby are simpler, less expensive, and exhibit a stronger magnetic field than the prior art magnetic deactivators.

What is claimed:

1. Apparatus for producing a complex magnetization pattern in a sheet of magnetic material, comprising:

a magnetizing fixture having top and bottom plates, the top and bottom plates each having a conductor embedded in one surface thereof, the conductors forming matching folded serpentine patterns covering substantially the entire surface of the plate, in operation the sheet of magnetic material being placed between said top and bottom plates adjacent said folded serpentine conductor patterns; and capacitor discharge magnetizing circuit means connected to the conductors for delivering a magnetizing pulse of current to the conductors.

2. The apparatus claimed in claim 1, wherein said top and bottom plates comprise high permeability low-carbon steel, and said conductors being embedded in grooves in the surface of said steel plate with epoxy.

3. The apparatus claimed in claim 1, wherein said top and bottom plates comprise non-magnetic phenolic resin.

4. The apparatus claimed in claim 1, wherein the conductor is 16 gauge copper wire.

5. The apparatus claimed in claim 1, further comprising spacer means disposed around the periphery of one of said plates.

6. A method of producing a complex folded serpentine magnetic pattern in a sheet of magnetic material suitable for use in a magnetic target demagnetizer, comprising the steps of:

(a) providing a magnetizing fixture having top and bottom plates, each having a conductor embedded in one surface thereof;

(b) placing a sheet of magnetic material between the plates of the magnetizing fixture; and (c) applying a magnetizing current to the conductors employing a capacitor discharge magnetizer.

7. The method claimed in claim 6, wherein the top and bottom plates are high permeability low-carbon steel.

8. A magnetic article formed according to the steps of claim 6.

* * * * *